US007733281B2

(12) United States Patent
Karaoguz et al.

(10) Patent No.: US 7,733,281 B2
(45) Date of Patent: Jun. 8, 2010

(54) COMBINED SATELLITE AND BROADBAND ACCESS ANTENNAS USING COMMON INFRASTRUCTURE

(75) Inventors: Jeyhan Karaoguz, Irvine, CA (US); James Bennett, San Clemente, CA (US)

(73) Assignee: Broadcom Corporation, Irvine, CA (US)

( * ) Notice: Subject to any disclaimer, the term of this patent is extended or adjusted under 35 U.S.C. 154(b) by 1298 days.

(21) Appl. No.: 10/937,315

(22) Filed: Sep. 10, 2004

(65) Prior Publication Data

US 2006/0055611 A1 Mar. 16, 2006

(51) Int. Cl.
*H01Q 3/00* (2006.01)

(52) U.S. Cl. ..... 343/757; 343/873

(58) Field of Classification Search ..... 343/757, 343/775, 779, 781, 760, 840; 455/427
See application file for complete search history.

(56) References Cited

U.S. PATENT DOCUMENTS 5,818,517 A * 10/1998 Hudson et al. ..... 348/21
5,930,680 A * 7/1999 Lusignan ..... 455/12.1
6,204,822 B1 * 3/2001 Cardiasmenos et al. ..... 343/761
6,754,584 B2 * 6/2004 Pinto et al. ..... 701/215
6,950,073 B2 * 9/2005 Clymer et al. ..... 343/713

* cited by examiner

*Primary Examiner*—Hung T Vy
(74) *Attorney, Agent, or Firm*—McAndrews, Held & Malloy, Ltd.

(57) ABSTRACT

A method of installing multiple over-the-air antennas is disclosed. The method includes the steps of mounting a satellite antenna to a installation surface, such that the mounting allows the satellite antenna to be aimed at a satellite, attaching a broadband access antenna to one of the installation surface and a portion of the satellite antenna, such that the attaching allows the broadband access antenna to be aimed at a broadband access source, connecting first wiring from the broadband access antenna to a first downconverter and second wiring from the satellite antenna to a second downconverter, providing outputs of the first and second downconverters to a cable in communication with at least a satellite receiver and positioning, on at least a coarse scale, the satellite antenna and the broadband access antenna such that they are approximately pointed at the satellite and the broadband access source, respectively.

25 Claims, 5 Drawing Sheets

COMBINED SATELLITE AND BROADBAND ACCESS ANTENNAS USING COMMON INFRASTRUCTURE

BACKGROUND OF THE INVENTION

1. Field of Invention

The present invention relates to broadband access to data through multiple mechanisms in a home or business. In particular, the present invention is directed to combined antenna structures for satellite and broadband access and the provision for transmission and receipt of data through a common infrastructure.

2. Description of Related Art

The availability of the distribution of programming in the United States and abroad via satellite is ubiquitous. Consumers position a satellite dish, or have the same installed, to communicate with satellites that are in geosynchronous orbit and are able to send and/or receive data. Different types of satellite dishes can be used, based on the provider of satellite data, as well as on the number of satellites that are to be received by the satellite dish antenna. Currently, such data has an approximate downstream, i.e. from the satellite to the satellite receiver connected to the satellite dish, throughput of about 40 megabit per second. This allows for the receiver to readily receive data, such as television schedule data, as well as video and other programming, and to display that data to the end user. There are at present many different types of satellite services providing satellite television programming, as well services providing Internet access through satellite communication.

However, the upstream, i.e. from the receiver to the satellite, speeds are much less. The upstream path, through, for example, the Ka-band, provides only for low bandwidth at rates of approximately 3 MHz. The disjoint upstream and downstream paths are understandable because of the number of users of the service. In other words, there are many end users seeking to receive the same data, i.e. television programming, and the need to send data upstream at a rate similar to the downstream rate is not present. Thus, while the difference in the upstream and downstream rates poses no real problem for satellite television, the difference becomes a distinct disadvantage if a user sought to use the satellite infrastructure to send and receive data at parity rates.

Thus, there exist many satellite television users that have the capacity to receive high speed data, i.e. their satellite systems, but must utilize other means to provide Internet access or send data upstream. Such access could be through dialup connections or through Digital Subscriber Line (DSL) or cable modems. All of those options require additional wiring or limit the access rate. In satellite based Internet access, the above-discussed disparity in upstream and downstream rates usually requires for a user having such satellite based Internet access to have an additional upstream path, such as through DSL or cable modems. This creates a dichotomy for the end user in that the user must have dealings with both satellite service providers and cable service providers, where the providers distribute overlapping services.

Additionally, other types of high speed data access are also being developed. One such technology is covered through various incarnations of Institute of Electrical and Electronics Engineers (IEEE) 802.16 standard. Such access is often referred to as broadband access, Wimax or fixed broadband wireless. IEEE 802.16 is a specification for fixed broadband wireless networks that use a point-to-multipoint architecture. The standard defines the use of bandwidth between the licensed 10 GHz and 66 GHz and between the 2 GHZ and 11 GHz (licensed and unlicensed) frequency ranges and defines a Media Access Control (MAC) layer that supports multiple physical layer specifications customized for the frequency band of use and their associated regulations. 802.16, depending on the embodiment, supports data rates of between 32-134 Mbps at 28 MHz channels, up to 75 Mbps at 20 MHz channels or up to 15 Mbps at 5 MHz channels. 802.16 supports these very high bit rates in both uploading to and downloading from a base station up to a distance of 30 miles to handle such services as Internet Protocol (IP) connectivity, Voice over IP, and Time Division Multiplexing (TDM) voice and data.

However, for most incarnations of wireless broadband access, there is need for an additional antenna to receive the signal. Additionally, in some types of broadband access, there is a need for a line-of-sight between the source and the receiving antenna, often requiring that the antenna for broadband access to external to a home or office and requiring that the antenna to be directionally configurable to receive the signal. However, this may require complicated installation and positioning and, in environments where satellite communication is available, a duplication of infrastructure. Thus, there is a need in the prior art for systems that would allow for the joint installation and utilization of the over-the-air data transfer technologies.

SUMMARY OF THE INVENTION

According to one embodiment of the invention, a method of installing multiple over-the-air antennas is disclosed. The method includes the steps of mounting a satellite antenna to a installation surface, such that the mounting allows the satellite antenna to be aimed at a satellite, attaching a broadband access antenna to one of the installation surface and a portion of the satellite antenna, such that the attaching allows the broadband access antenna to be aimed at a broadband access source, connecting first wiring from the broadband access antenna to a first downconverter and second wiring from the satellite antenna to a second downconverter, providing outputs of the first and second downconverters to a cable in communication with at least a satellite receiver and positioning, on at least a coarse scale, the satellite antenna and the broadband access antenna such that they are approximately pointed at the satellite and the broadband access source, respectively.

Additionally, the first downconverter and the second downconverter may be a common downconverter, where an output of the common downconverter to may be provided to a single cable in communication with at least a satellite receiver. Additionally, at least one additional broadband access antenna may be provided and attached to a support section of the satellite antenna. The at least one additional broadband access antenna may be a directional broadband access antenna or a non-directional broadband access antenna In addition, the step of attaching a broadband access antenna may include attaching the broadband access antenna to the portion of the satellite antenna and the step of positioning the satellite antenna and the broadband access antenna may be accomplished by adjusting an adjustment mechanism on a coupling between the satellite antenna and the broadband access antenna. Also, a signal from a terrestrial antenna may be coupled into one of the first downconverter and the second downconverter.

According to another embodiment, a combined satellite and broadband access antenna assembly is disclosed. The assembly includes a satellite antenna, having a mounting structure that is configured to mount to an installation surface that allows the satellite antenna to be aimed at a satellite, and having a first output wiring, a broadband access antenna, attached to one of the installation surface and a portion of the satellite antenna, such that the attaching allows the broadband access antenna to be aimed at a broadband access source, and having a second output wiring and a common downconverter, having inputs connected to the first and second wiring and an output to a cable in communication with at least a satellite receiver.

According to another embodiment, a downconverter for signals received from multiple over-the-air antennas is disclosed. The downconverter includes a satellite antenna input, for receiving a first signal from a satellite antenna, a broadband access antenna input, for receiving a second signal from a broadband access antenna, downconverting circuitry, receiving at least the first and second signals and providing a downconverted output signal, at least one output port, for outputting the downconverted output signal and a common circuit providing connections between the satellite antenna input, the broadband access antenna input, the downconverting circuitry and the at least one output port.

According to another embodiment, a downconverter for signals received from multiple over-the-air antennas is disclosed. The downconverter includes a satellite antenna input means for receiving a first signal from a satellite antenna, a broadband access antenna input means for receiving a second signal from a broadband access antenna, downconverting circuitry means for receiving at least the first and second signals and providing a downconverted output signal, output port means for outputting the downconverted output signal and common circuit means for providing connections between the satellite antenna input, the broadband access antenna input, the downconverting circuitry and the at least one output port.

These and other variations of the present invention will be described in or be apparent from the following description of the preferred embodiments.

BRIEF DESCRIPTION OF THE DRAWINGS

For the present invention to be easily understood and readily practiced, the present invention will now be described, for purposes of illustration and not limitation, in conjunction with the following figures.

DETAILED DESCRIPTION OF PREFERRED EMBODIMENTS

In embodiments of the present invention discussed herein, a combination of an antenna for receipt of satellite signals and an antenna for receipt of broadband access allows for many improvements over the prior art. The combination of antennas allows for both antennas to be installed at the same time and allows for the required shared infrastructure to also to be installed concurrently. The combination of antennas also allows for coarse directional aiming of both antennas to be performed in concert and for the antennas to share common infrastructures, such as electronic circuitry and cabling.

Figure 1:
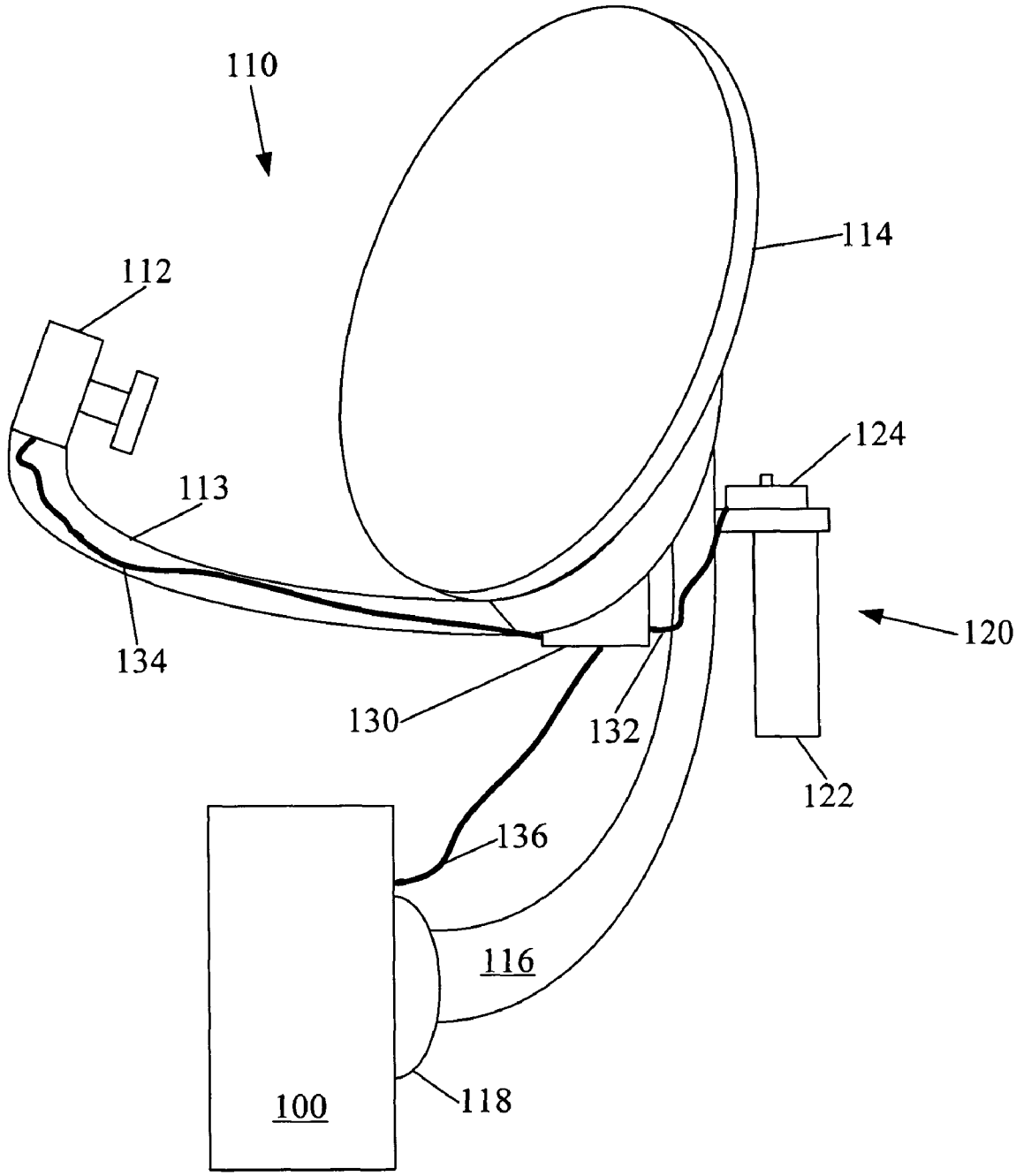
FIG. 1 provides an illustration of a combined satellite antenna and broadband access antenna and associated circuitry and wiring, according to one embodiment of the present invention.

A combined satellite antenna and broadband access antenna, according to one embodiment, is illustrated in FIG. 1. The appearance of the elements is for illustrative purposes only, and is not intended to be limiting. Satellite antenna 110 has a dish or collimating section 114 and at least one low noise converter (LNC) 112, supported by arm 113, where the LNC is focused at one of the foci of the dish. LNC 112 acts to convert a received signal to the 950-2150 MHz range and amplified that signal. The amplified signal is sent, along cabling 134, to a downconverter 130. The downconverter does a further conversion of the signal and sends the signal to at least the building along cable 136.

The satellite antenna 110 is supported to an attachment support 116, which affixes the satellite antenna to a support 100. The support 100 can be a portion of a building housing the satellite receiver or may be a pole if the satellite antenna needs to be so mounted to receive a signal from the proper satellite. The attachment support 116 is connected to the support 100 through an adjustable connector 118. the adjustable connector allows for partial positioning of the satellite antenna to receive signals from the satellite. Additional adjustment mechanisms, not illustrated, are provided closer to the dish portion 114 to allow for positioning over additional degrees of freedom.

Also illustrated in the combined antenna assembly is a broadband access antenna 120. According to certain embodiments of the invention, the broadband access antenna is affixed to the support sections of the satellite antenna 110. Alternatively, the broadband access antenna could be mounted next to but not attached to the satellite antenna. Additionally, while FIG. 1 illustrates the broadband access antenna being attached to a section of the attachment support 116, the broadband access antenna can be attached to any stable portion of the satellite antenna. The broadband access antenna 120 includes a transmission and receive section 122 and an adjustment mechanism 124. The adjustment mechanism allows for the transmission and receive section to be aimed at the source of the broadband access transmitter. The signal received through the broadband access antenna is carried to the downconverter 130 through a cable 132.

As illustrated in FIG. 1, the combined antennas allows for several benefits, according to many embodiments. First, where the antennas are installed on a roof, a pole, or other area with limited access, the installation can be accomplished at the same time for reduced costs when compared with two separate installations. Additionally, the combined antenna assembly allows for the use of a single downconverter for both types of signals received from the antennas, given that both signals received by the downcoverter are generally in the higher frequency range. Also, the combined antenna assembly allows for the same cabling to be employed to bring the signal to a satellite receiver or other conversion unit. In several embodiments, the combining of the different signals can be accomplished by multiplexing the signals at different carrier frequencies and sending those multiplexed signals along a single cable. Additionally, the above-described benefits are also achieved in embodiments of the present invention where a single antenna is employed for both types of signals, i.e. a single antenna that receives both a satellite and broadband access signals.

Figure 2A:
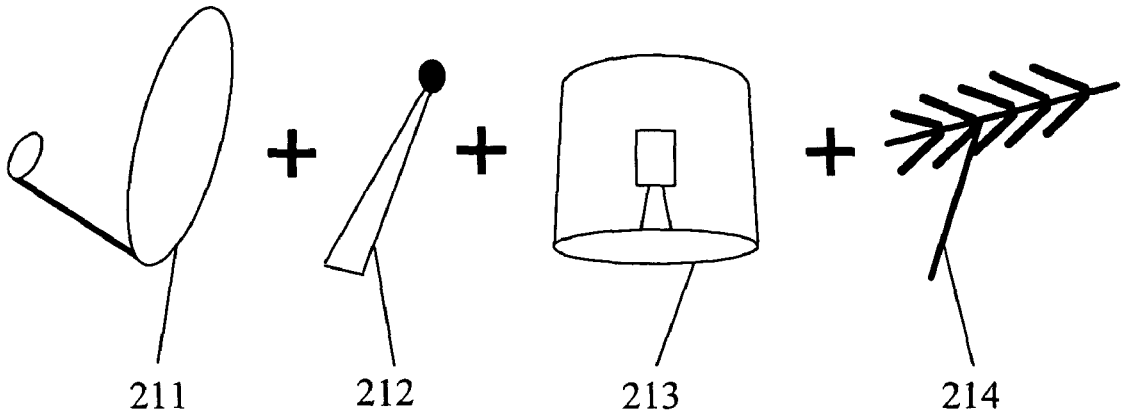
FIG. 2(*a*) illustrates different types of antenna that may be used and/or combined to provide over-the-air data access, with FIG. 2(*b*) illustrating a downconverter for converting signals received from the antennas and supplying them internally to the home or office, according to one embodiment of the present invention.
Figure 2B:
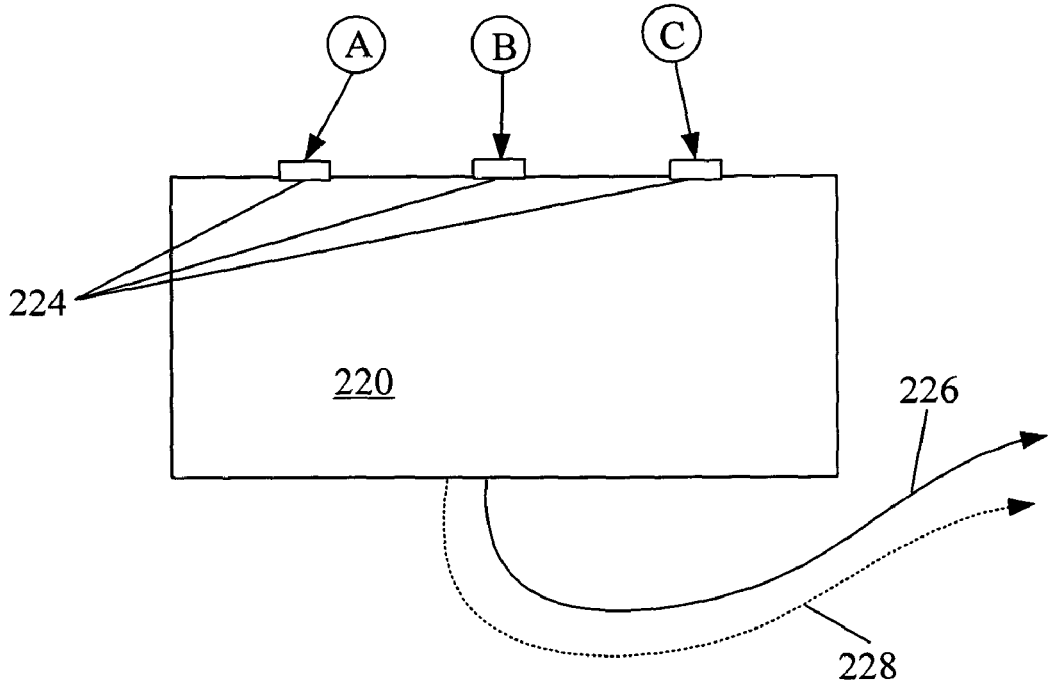

Through the present invention, multiple types of signals can be handled through a single component. FIG. 2(*a*) illustrates some of the different over-the-air antennas that may be used in conjunction with the present invention. The antennas include a satellite antenna 211, a dipole type broadband access antenna 212, a directional broadband access antenna 213 and a terrestrial antenna 214. Terrestrial antenna 214 can be used to receive electromagnetic signals, such as radio and television signals. While the signals received from terrestrial antenna 214 need not be downconverted, the present invention can allow for those signals received by the terrestrial antenna to be combined with other signals to aid in simplicity.

FIG. 2(*b*) illustrates a simplified schematic of a downconverter 220, according to an embodiment of the present invention. The downconverter has multiple input ports 224 for receiving signals from antenna sources discussed above. The downconverter allows the received signals to be shifted to another frequency to avoid loss during transmission along the cabling to the receiver or other component. The signals may also be multiplexed and sent along a single cable 226 to be used by components. While in certain embodiments of the present invention a single cable is used for simplicity and economy, additional cables 228 may also be used to output the downconverted signals. One reason for such additional cabling may be a requirement that the signals being separated by some distances, or similar reason.

Figure 3:
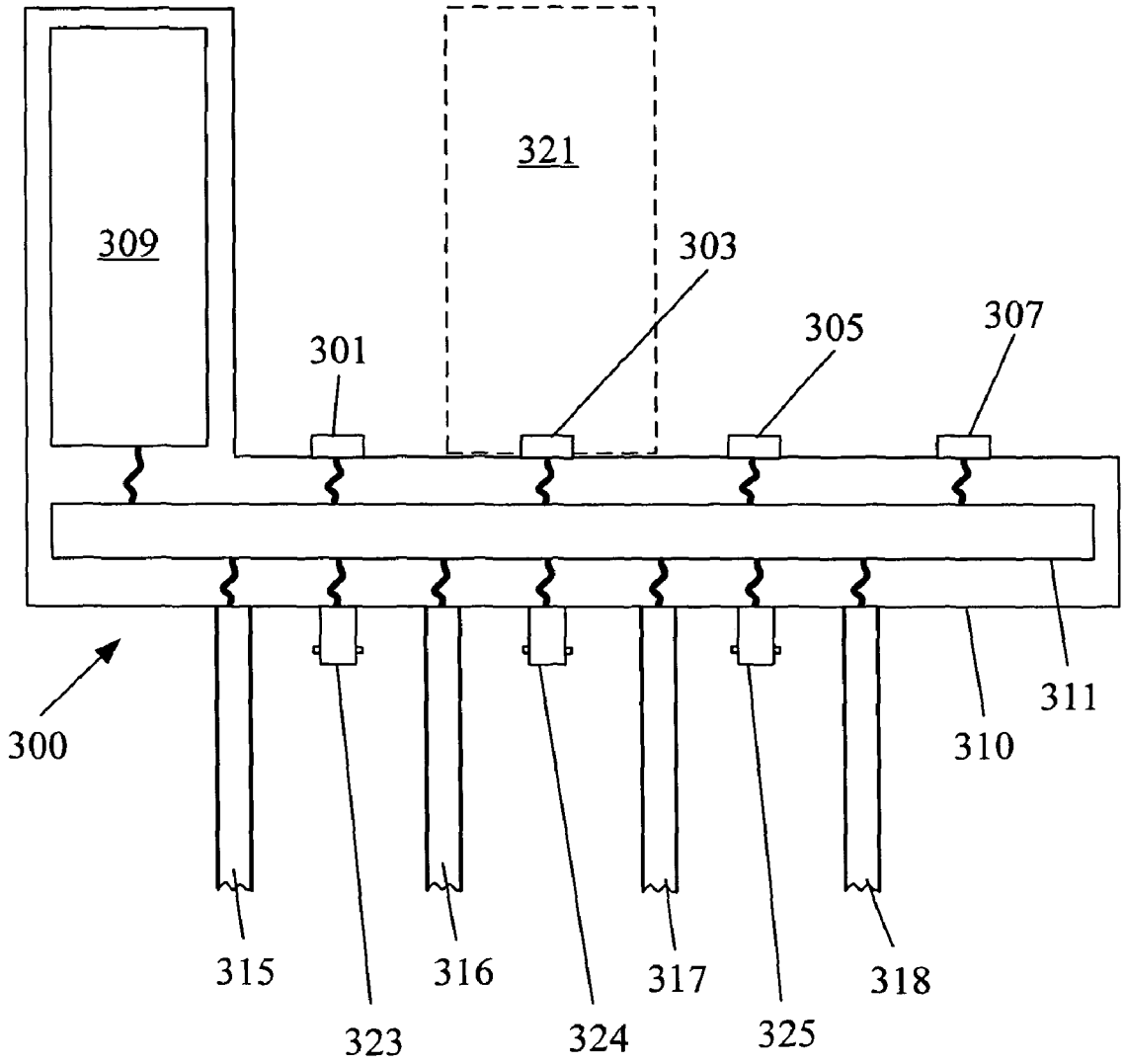
FIG. 3 provides an example of a downconverter assembly, according to one embodiment of the present invention.

An additional embodiment of the downconverter assembly 300 is illustrated in FIG. 3. The downconverter assembly can contain at least one downconverter unit 309 that is a permanent portion of the downconverter assembly. Signals from the different antennas are supplied to the downconverter assembly through attachments 323-325. These attachments may be of the BNC type or other connection mechanism. The inputs are connected to a common communication circuit that can act to transfer signals to and from the downconverter unit 309 and the input attachments 323-325 and outputs 315-318. The downconverter assembly works, for example, by receiving a signal from a satellite signal, converting the signal into a lower frequency signal and outputting the downconverted satellite signal. The downconverter assembly also includes add-in ports 301-307, so that additional add-in modules, such as 321, can be added to provide additional functionalities.

Figures 4, 4A, 4B:
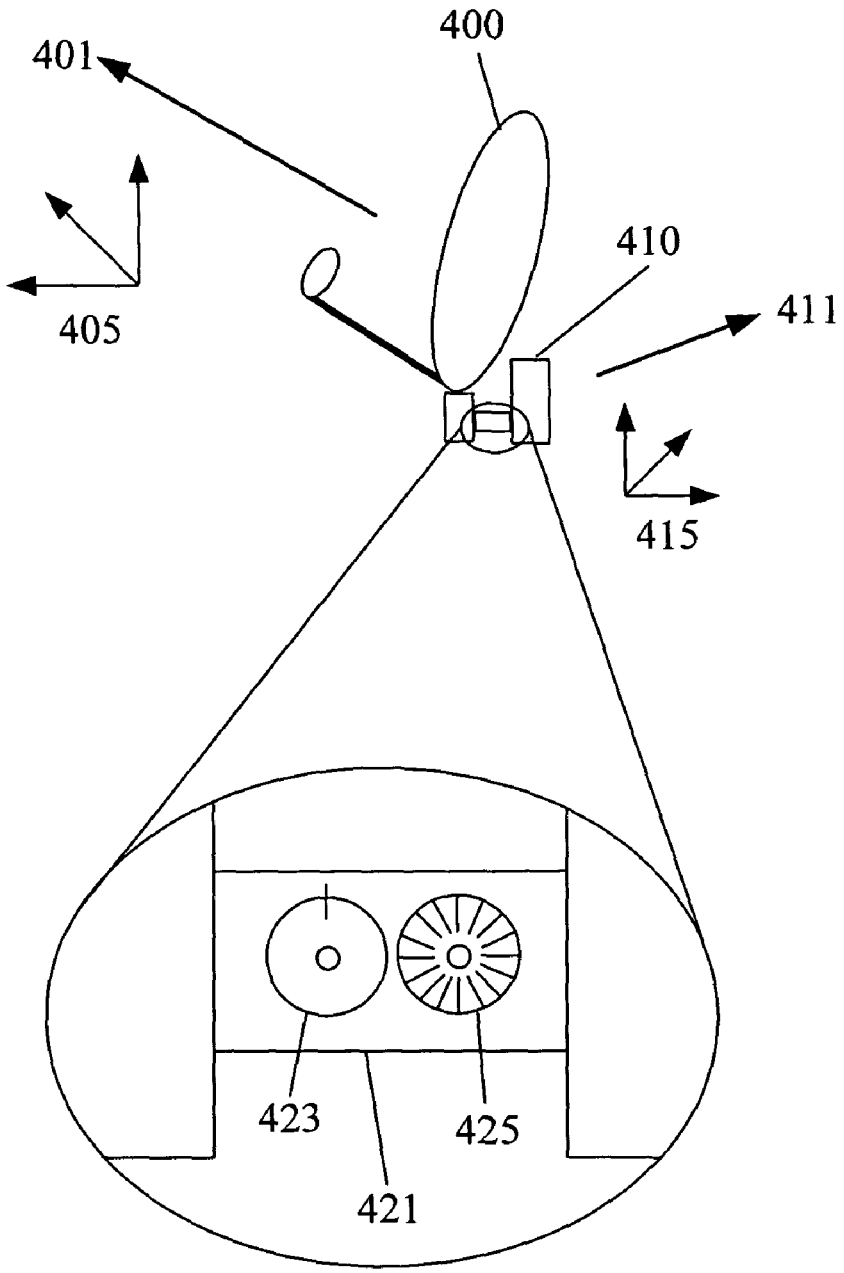
FIG. 4 illustrates a coupled positioning system for a broadband access antenna, with FIG. 4(*a*) showing the relationship between positioning system to the antennas and FIG. 4(*b*) showing the positioning system in greater detail, according to one embodiment of the present invention.

In addition to use of common installation, circuitry and cabling, the coupling of multiple antennas together also has additional benefits, according to some embodiments. In the case of directional broadband access antennas, those antennas must be aimed in order to achieve proper communication. Since the satellite antenna must be aimed to achieve communication with the satellite, the aiming of one antenna can be used to provide adjustment of another, at least to a coarse degree. As illustrated in FIG. 4(*a*), the satellite antenna 400 is aimed in a particular direction 401, according to axes 405 of the antenna. The coarse adjustment settings for satellite antennas are often made through consultation with a website for the satellite services provider or a lookup table. In one example, a person might enter the postal code of their area, and receive initial, coarse settings for aiming the satellite antenna.

As illustrated in FIG. 4(*a*), the directional broadband access antenna 410 is aimed in a direction 411, based on axes 415. As illustrated in FIG. 4(*b*), the connection between the antennas 421 includes an adjustment mechanism. The adjustment mechanism can include setting mechanisms 423 and 425 that allow for adjustment of the directional broadband access antenna. One setting mechanism, such as, for example, 423, may control a tilt of the directional broadband access antenna, and the other 425 control a lateral aiming of the antenna. As part of the installation of both antennas, the coarse positioning of both can be established through consultation of a table or website to speed up the initial positioning of the antennas.

Figure 5:
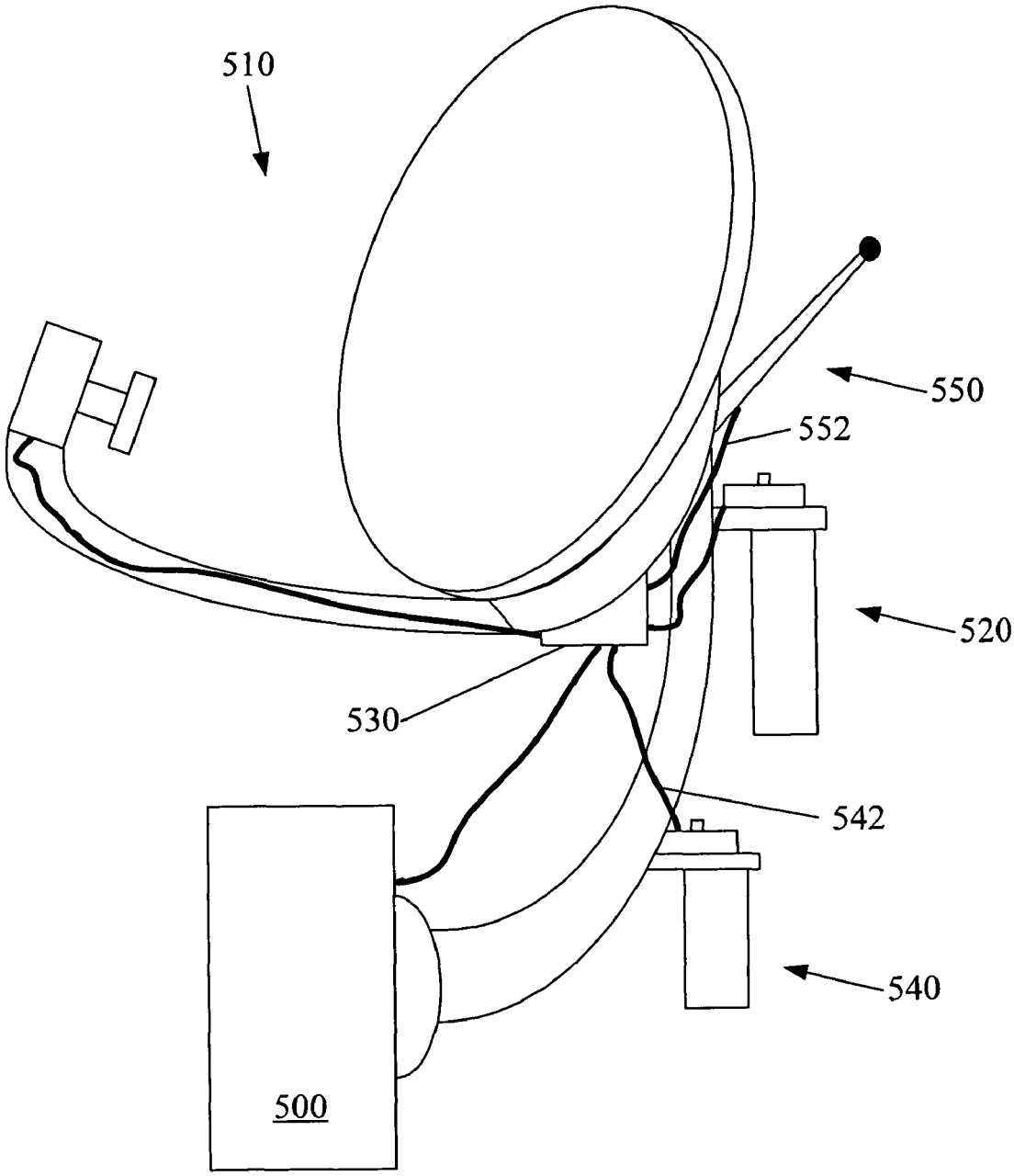
FIG. 5 provides an illustration of a combined satellite antenna and broadband access antenna and associated circuitry and wiring, with multiple types of broadband access antennas coupled to the satellite antenna, according to one embodiment of the present invention.

FIG. 5 illustrates one example of an additional embodiment of the present invention, similar in some respects to that illustrated in FIG. 1. This embodiment includes a satellite antenna 510 and a broadband access antenna 520, coupled to a support structure 500. Instead of coupling just the two antennas as illustrated in FIG. 1, FIG. 5 illustrates additional antennas 540 and 550 coupled to a downconverter 530 through respective cabling 542 and 552. One rationale for having multiple types of antennas is redundancy, where if a single component antenna or a specific source of the broadband access source were to fail, the broadband access would still be intact in some form.

The invention also addresses the limitation found in satellite systems where the upstream data stream is limited in the amount of data it can carry. The invention also addresses the need of new broadband wireless systems that require new antennas and infrastructures to compete with preexisting broadband systems. Since both systems function in the 11 Ghz band, the broadband access and the satellite systems can share common technology to down convert both signals. In addition, both down-converted signals can be transported using the same wiring to a common set-top box or to separate systems where their respective signals are used. The use of common wiring may be utilized through the multiplexing of the different types of signals at different carrier frequencies.

Although the invention has been described based upon these preferred embodiments, it would be apparent to those skilled in the art that certain modifications, variations, and alternative constructions would be apparent, while remaining within the spirit and scope of the invention. In order to determine the metes and bounds of the invention, therefore, reference should be made to the appended claims.

The invention claimed is:

1. A method of installing multiple over-the-air antennas, the method comprising the steps of:

mounting a satellite antenna to a installation surface, such that the mounting allows the satellite antenna to be adjusted to communicate with a satellite;

attaching a broadband access antenna to one of the installation surface and a portion of the satellite antenna, such that the attaching allows the broadband access antenna to be adjusted to communicate with a broadband access source;

connecting first wiring from the broadband access antenna to a first downconverter and second wiring from the satellite antenna to a second downconverter;

providing outputs of the first and second downconverters to a cable in communication with at least a satellite receiver; and positioning, on at least a coarse scale, the satellite antenna and the broadband access antenna such that they are approximately optimized for communication the satellite and the broadband access source, respectively.

2. A method according to claim 1, wherein the step of connecting first wiring from the broadband access antenna to a first downconverter and second wiring from the satellite antenna to a second downconverter comprises connecting the first and second wiring to a common downconverter.

3. A method according to claim 2, wherein the step of providing outputs of the first and second downconverters comprises providing an output of the common downconverter to a single cable in communication with at least a satellite receiver.

4. A method according to claim 1, further comprising providing at least one additional broadband access antenna and attaching the at least one additional broadband access antenna to a support section of the satellite antenna.

5. A method according to claim 4, wherein the step of providing at least one additional broadband access antenna comprises providing a directional broadband access antenna.

6. A method according to claim 4, wherein the step of providing at least one additional broadband access antenna comprises providing a non-directional broadband access antenna.

7. A method according to claim 1, wherein the step of attaching a broadband access antenna comprises attaching the broadband access antenna to the portion of the satellite antenna; and wherein the step of positioning the satellite antenna and the broadband access antenna comprises adjusting an adjustment mechanism on a coupling between the satellite antenna and the broadband access antenna.

8. A method according to claim 1, further comprising a step of coupling a signal from a terrestrial antenna into one of the first downconverter and the second downconverter.

9. An antenna assembly, comprising:

a satellite antenna, having a mounting structure that is configured to mount to an installation surface that allows the satellite antenna to be adjusted to communicate with a a satellite, and having a first output wiring;

a broadband access antenna, attached to one of the installation surface and a portion of the satellite antenna, wherein the broadband access antenna can be adjusted to communicate with a broadband access source, and having a second output wiring; and a common downconverter, having inputs connected to the first and second wiring and an output to a cable in communication with at least a satellite receiver.

10. An assembly according to claim 9, wherein the common downconverter is attached to a section of the satellite antenna.

11. An assembly according to claim 9, further comprising at least one additional broadband access antenna, attached to a support section of the satellite antenna, the at least one additional broadband access antenna having an output connected to the common downconverter.

12. An assembly according to claim 11, wherein the at least one additional broadband access antenna comprises a directional broadband access antenna.

13. An assembly according to claim 11, wherein the at least one additional broadband access antenna comprises a non-directional broadband access antenna.

14. An assembly according to claim 9, wherein the broadband access antenna is attached to the portion of the satellite antenna through a coupling and the coupling includes an adjustment mechanism to configured to adjust relative orientations of the satellite antenna and the broadband access antenna.

15. An assembly according to claim 9, wherein the common downconverter is configured to receive a signal from a terrestrial antenna.

16. A downconverter for signals received from multiple over-the-air sources, comprising:

a satellite antenna input, for receiving a first signal from a satellite antenna;

a broadband access antenna input, for receiving a second signal from a broadband access antenna;

downconverting circuitry, receiving at least the first and second signals and providing a downconverted output signal;

at least one output port, for outputting the downconverted output signal; and a common circuit providing connections between the satellite antenna input, the broadband access antenna input, the downconverting circuitry and the at least one output port.

17. A downconverter according to claim 16, further comprising an additional broadband access antenna input, receiving a third signal from an additional broadband access antenna and connection with the common circuit.

18. A downconverter according to claim 16, further comprising a terrestrial antenna input, receiving a third signal from an terrestrial antenna and connection with the common circuit.

19. A downconverter according to claim 16, further comprising an add-in downconverter module slot, configured to receive a downconverter module, where the downconverter module slot has an interface connected to the common circuit.

20. A downconverter according to claim 16, wherein the satellite antenna input and the broadband access antenna input are configured to receive the first and second signals from a combined antenna configured to receive both satellite and broadband access signals.

21. A downconverter for signals received from multiple over-the-air sources, comprising:

a satellite antenna input means for receiving a first signal from a satellite antenna;

a broadband access antenna input means for receiving a second signal from a broadband access antenna;

downconverting circuitry means for receiving at least the first and second signals and providing a downconverted output signal;

output port means for outputting the downconverted output signal; and common circuit means for providing connections between the satellite antenna input, the broadband access antenna input, the downconverting circuitry and the at least one output port.

22. A downconverter according to claim 21, further comprising an additional broadband access antenna input means for receiving a third signal from an additional broadband access antenna and connecting with the common circuit.

23. A downconverter according to claim 21, further comprising a terrestrial antenna input means for receiving a third signal from an terrestrial antenna and connecting with the common circuit.

24. A downconverter according to claim 21, further comprising an add-in downconverter module slot means for receiving a downconverter module, where the downconverter module slot means has an interface connected to the common circuit.

25. A downconverter according to claim 16, wherein the satellite antenna input means and the broadband access antenna input means are configured to receive the first and second signals from a combined antenna configured to receive both satellite and broadband access signals.

* * * * *